US010498023B2

(12) United States Patent
Lin et al.

(10) Patent No.: US 10,498,023 B2
(45) Date of Patent: Dec. 3, 2019

(54) ANTENNA ARRAY WITH ADJUSTABLE SIGNAL-FEEDING POINTS

(71) Applicant: Alpha Networks Inc., Hsinchu (TW)

(72) Inventors: Ching-Hong Lin, Hsinchu (TW); Rong-Fa Kuo, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 0 days.

(21) Appl. No.: 16/111,400

(22) Filed: Aug. 24, 2018

(65) Prior Publication Data

US 2019/0157753 A1 May 23, 2019

(30) Foreign Application Priority Data

Nov. 23, 2017 (TW) ..... 106140636 A

(51) Int. Cl.

*H01Q 21/00* (2006.01)
*H01Q 1/52* (2006.01)
*H01Q 21/06* (2006.01)

(52) U.S. Cl.

CPC ..... *H01Q 1/523* (2013.01); *H01Q 21/0006* (2013.01); *H01Q 21/061* (2013.01)

(58) Field of Classification Search

CPC ..... H01Q 21/0006–08; H01Q 1/52
USPC ..... 343/700 MS, 853, 893
See application file for complete search history.

(56) References Cited

U.S. PATENT DOCUMENTS 4,079,268 A 3/1978 Fletcher
4,464,663 A * 8/1984 Lalezari ..... H01Q 9/0435 343/700 MS
4,686,535 A 8/1987 Lalezari
9,368,881 B2 * 6/2016 Lee ..... H01Q 1/3233
(Continued)

FOREIGN PATENT DOCUMENTS

TW 555175 9/2003
TW 587846 5/2004
(Continued)

OTHER PUBLICATIONS

Taiwan Patent Office "Office Action" dated Aug. 15, 2018, Taiwan.
Taiwan Patent Office "Office Action" dated Oct. 1, 2019, Taiwan.

*Primary Examiner* — Dameon E Levi
*Assistant Examiner* — Hasan Z Islam
(74) *Attorney, Agent, or Firm* — WPAT, PC

(57) ABSTRACT

An antenna array includes an external input signal feeding point for receiving or transmitting therefrom an input signal or an output signal; signal transmission lines; and antenna units including a starting antenna unit coupled to the external input signal feeding point via a starting feeding point thereof, and being interconnected via the plurality of signal transmission lines. The input/output signal delivered from the external input signal feeding point enters the starting antenna unit from the starting feeding point and is further transmitted to the other antenna units through the signal transmission lines. Each of the antenna units is defined with a default feeding point at a position corresponding to a position of the starting feeding point in the starting antenna unit. One of the signal transmission lines has an end directly coupled to one of the antenna units at an actual feeding point different from the default feeding point for receiving therefrom the input signal.

11 Claims, 6 Drawing Sheets

(56) References Cited

U.S. PATENT DOCUMENTS

| | | | | |
|---|---|---|---|---|
| 2009/0219219 | A1* | 9/2009 | Pintos | H01Q 9/0407 343/853 |
| 2013/0187830 | A1 | 7/2013 | Warnick et al. | |
| 2013/0321214 | A1 | 12/2013 | Zhou et al. | |

FOREIGN PATENT DOCUMENTS

| | | |
|---|---|---|
| TW | M311142 | 5/2007 |
| TW | M383828 | 7/2010 |

* cited by examiner

ANTENNA ARRAY WITH ADJUSTABLE SIGNAL-FEEDING POINTS

FIELD OF THE INVENTION

The present invention relates to an antenna array, and more particularly to an antenna array with adjustable signal-feeding points.

BACKGROUND OF THE INVENTION

In prior art, antenna signals are fed in either a series-fed manner or a parallel-fed manner. A series-fed antenna architecture is schematically illustrated in FIG. 1A. As shown, a series of antenna units 100A are coupled to each other with respective input ends interconnected so as to form a one-dimensional antenna array A1, and the one-dimensional antenna array A1 has a common feeding point P1. Likewise, other one-dimensional antenna arrays A2, A3 and A4 are formed with respective feeding points P2, P3 and P4. The four longitudinal antenna arrays A1, A2, A3 and A4 are further combined into a two-dimensional antenna array AA1 with specific phase differences and intensity weight ratios of input signals, which are fed into the antenna array AA1 from the four feeding points P1, P2, P3 and P4. On the other hand, a parallel-fed antenna architecture is schematically illustrated in FIG. 1B. As shown, an input signal is fed into the two-dimensional antenna array AA2 through a feeding point P5. The two-dimensional antenna array AA2 is formed with four one-dimensional antenna arrays A5, A6, A7 and A8, and each of the antenna arrays A5, A6, A7 and A8 includes a plurality of antenna units 100B connected in parallel. In the two-dimensional antenna array AA2, phase differences and signal-intensity weight ratios associated with the four longitudinal antenna arrays A5, A6, A7 and A8 are controlled by way of impedance matching among transmission lines, and meanwhile, phase differences and signal-intensity weight ratios of the antenna units 100B in each of the antenna arrays A5, A6, A7 and A8 are also controlled by way of impedance matching among transmission lines.

No matter which kind of antenna architecture is adopted for designs, signal transmission lines are required to directly couple the feeding points to the one-dimensional antenna arrays. This confines the freedom of wiring designs of the entire antenna array. Moreover, the resulting traces would occupy a significant area of the antenna array and cause undesired interference. Miniaturization of the antenna array is hard to be achieved.

SUMMARY OF THE INVENTION

Therefore, the present invention provides an antenna array, which has a relatively flexible wiring design. Depending on design details, the space occupied by the traces in the antenna array may be reduced and the interference between the antenna array and the feeding lines can be ameliorated.

An aspect of the present invention relates to an antenna array. The antenna array includes an external input signal feeding point for receiving or transmitting therefrom an input signal or an output signal; a plurality of signal transmission lines; and a plurality of antenna units including a starting antenna unit coupled to the external input signal feeding point via a starting feeding point thereof, and being interconnected via the plurality of signal transmission lines so that the input or output signal delivered from the external input signal feeding point enters the starting antenna unit from the starting feeding point and is further transmitted to the other antenna units through the plurality of signal transmission lines, wherein each of the antenna units is defined with a default feeding point at a position corresponding to a position of the starting feeding point in the starting antenna unit. The antenna units further include first antenna units, which are referred to as lateral antenna units, and second antenna units, which are referred to as forward antenna units. A least a specified one of the signal transmission lines, which is referred to as a lateral signal transmission line, has a first end directly coupled to one of the first antenna units at an actual feeding point for delivering therefrom the input or output signal, wherein the actual feeding point of the first antenna unit is different from the default feeding point of the first antenna unit.

In an embodiment, the antenna units are arranged as a curve line with a certain curvature. In another embodiment, the antenna units are linearly arranged.

In an embodiment, at least one of the plurality of signal transmission lines is directly coupled to two adjacent ones of the antenna units. In another embodiment, at least one of the plurality of signal input lines is directly coupled to two of the antenna units, which are spatially separated by one or more of the other antenna units.

In an embodiment, the specified one of the signal transmission lines has a second end directly coupled to a second one of the antenna units at a characteristic position, and a state of the input signal transmitted to the first one of the antenna units through the specified one of the signal transmission lines varies with the characteristic position of the second one of the antenna units.

In another embodiment, a state of the input signal transmitted to the first one of the antenna units through the specified one of the signal transmission lines varies with a length and/or width of the specified one of the signal transmission lines.

In a further embodiment, a state of the input signal transmitted to the first one of the antenna units through the specified one of the signal transmission lines varies with the position of the actual feeding point of the first one of the antenna units.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
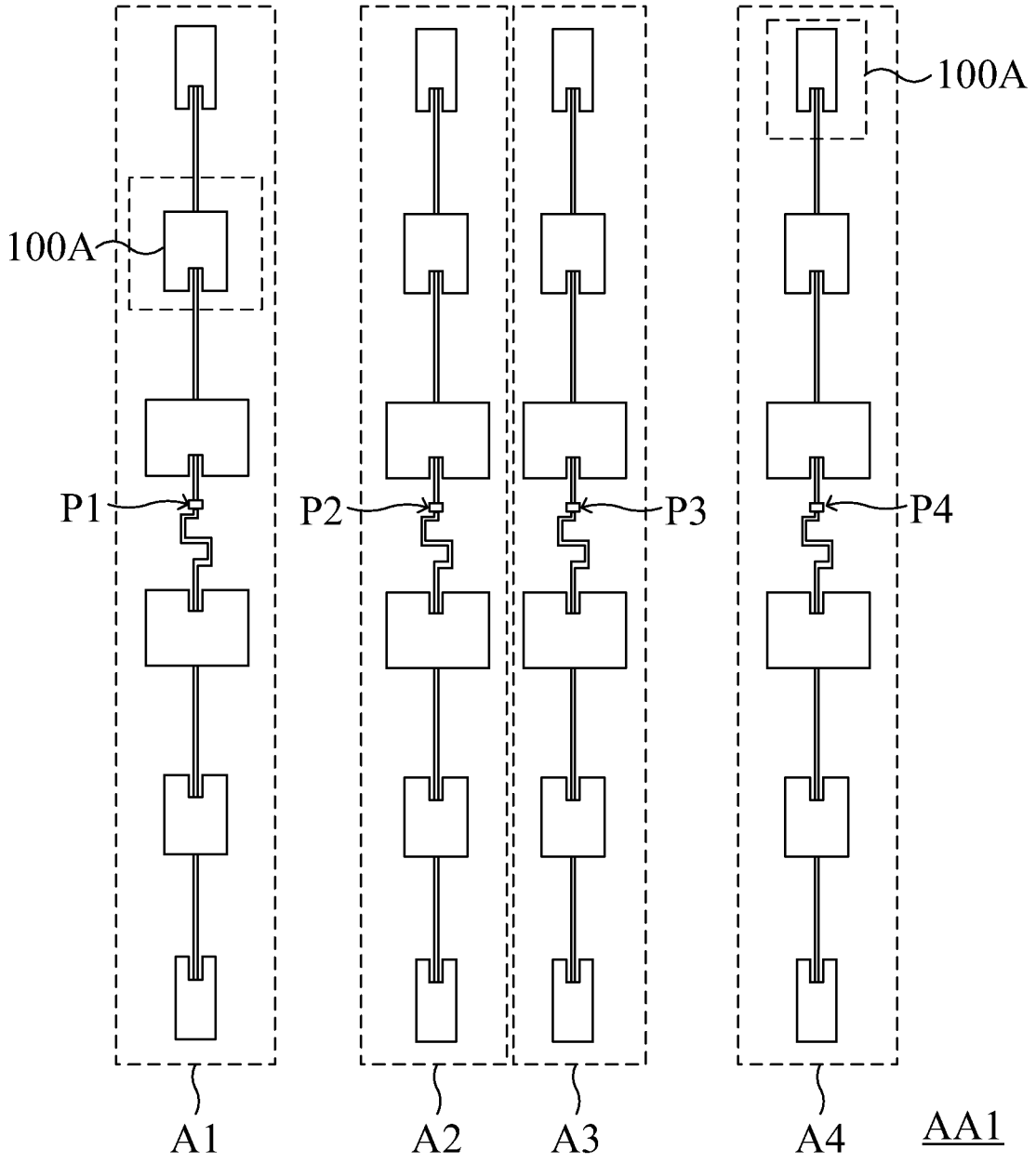
FIG. 1A (Prior Art)
FIG. 1A is a schematic diagram illustrating a conventional antenna architecture.
Figure 1B:
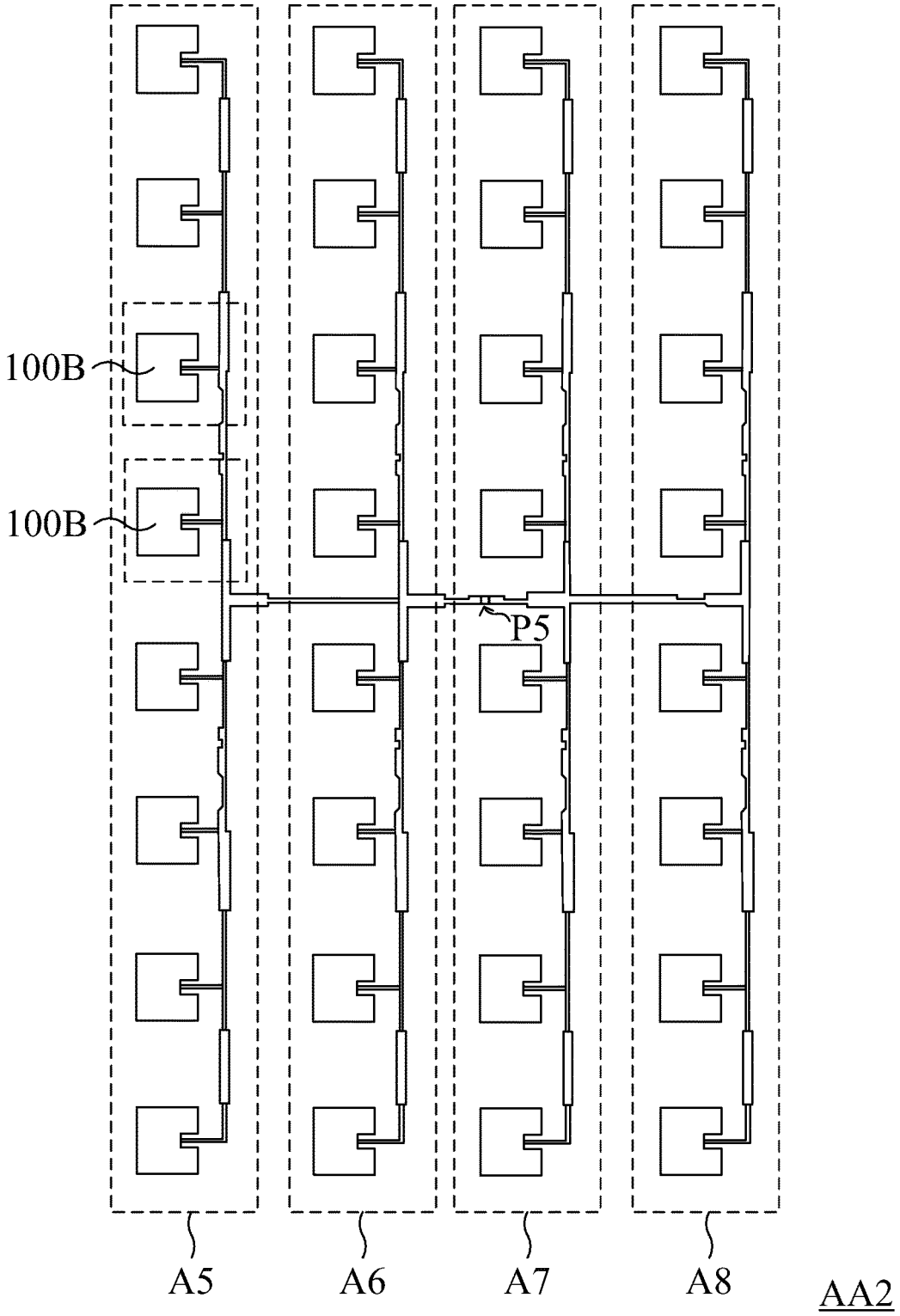
FIG. 1B (Prior Art)
FIG. 1B is a schematic diagram illustrating another conventional antenna architecture.
Figure 2:
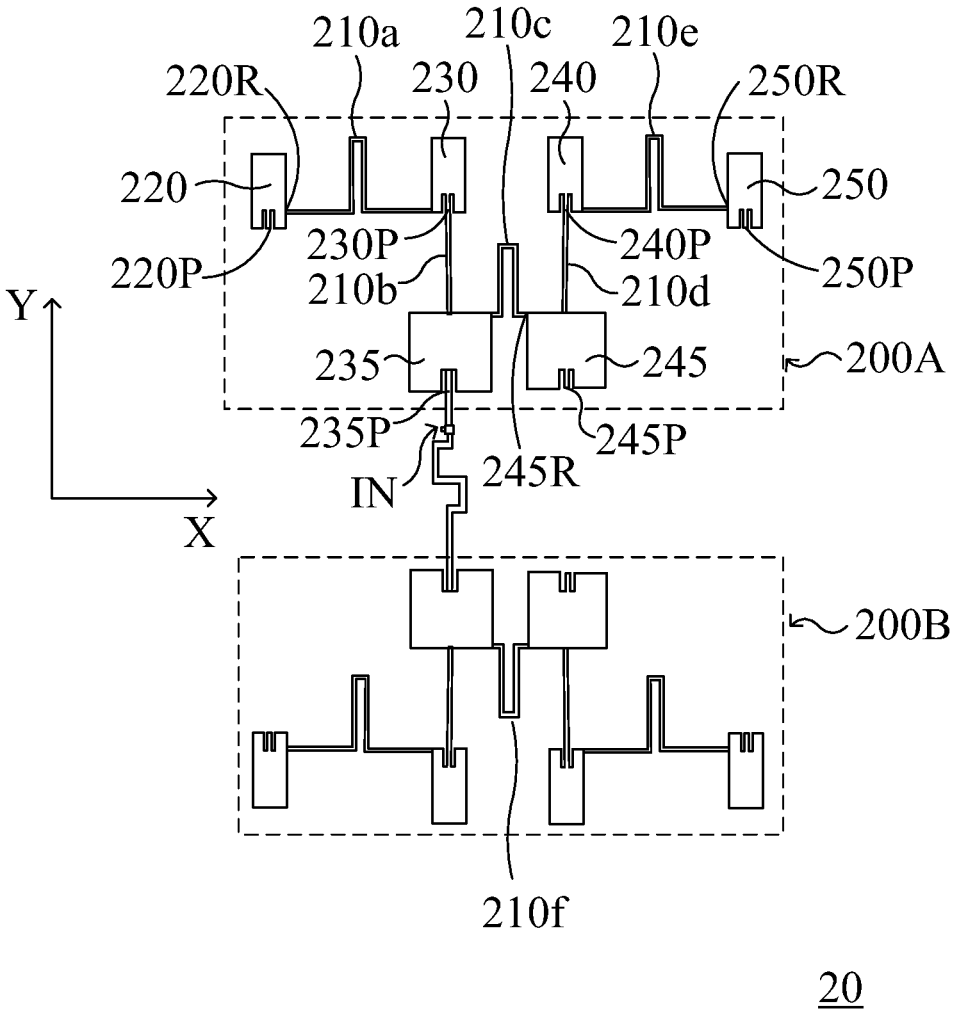
FIG. 2 is a schematic diagram illustrating an antenna array according to an embodiment of the present invention.

Please refer to FIG. 2, in which an antenna array according to an embodiment of the present invention is schematically shown. It is to be noted that in spite a two-dimensional antenna array 20 is exemplified, the antenna array according to the present invention is not to be limited to be two-dimensional.

As shown in FIG. 2, the antenna array 20 includes two similar antenna array units 200A and 200B. The antenna array units 200A and 200B both receive external input signals from a feeding point IN, or transmit output signals therefrom. Since the structures and operational principles of antenna array units 200A and 200B are similar, the antenna array unit 200A will be illustrated in more detail hereinafter and similar descriptions can be applied to the antenna array unit 200B.

In this embodiment, the antenna array unit 200A includes a plurality of signal transmission lines 210*a*, 210*b*, 210*c*, 210*d* and 210*e*, and a plurality of antenna units 220, 230, 235, 240, 245 and 250. The antenna unit 235 is coupled to the feeding point IN and receives the external input signal therefrom. In other words, the antenna unit 235 is the first antenna unit through which the external input signal enters the antenna array unit 200A, and is referred to as a starting antenna unit. Afterwards, signals are transmitted among the antenna units 220, 230, 240, 245 and 250 through the signal transmission lines 210*a*, 210*b*, 210*c*, 210*d* and 210*e*, so the external input signal, after being transmitted through the starting antenna unit 235, can be transmitted to the other antenna units 220, 230, 240, 245 and 250 through the signal transmission lines 210*a*-210*e*.

In more detail, after an external input signal enters the antenna array 20 from the feeding point IN, the input signal first enters the antenna unit 235, which is the starting antenna unit, from a feeding point 235P of the antenna unit 235, which is referred to as a starting point. The input signal, after being received from the starting point 235P and transmitted through the starting antenna unit 235, is transmitted to a coupling point between the antenna unit 235 and the signal transmission line 210*b*, and further to the antenna unit 230 through the signal transmission line 210*b*. The input signal enters the antenna unit 230 from its feeding point 230P. After the input signal is transmitted through the antenna unit 230, it is further transmitted to the antenna unit 220 from a feeding point 220R through the signal transmission line 210*a*.

Conventionally, the feeding points of the antenna units follow the feeding point of the starting antenna unit, i.e. the feeding point 235P of the starting antenna unit 235. In the conventional antenna array, the feeding point of each antenna unit is made to consist with the starting feeding point of the starting antenna unit. For example, in a polygonal antenna unit, a ratio of distances from the feeding point to the opposite vertices of the same edge, where the feeding point is located, is conventionally set to be equivalent to a ratio of distances from the starting feeding point to the opposite vertices of the same edge, where the starting feeding point is located. In a circular antenna unit, a slope of a line connecting the feeding point to the center of the circular antenna unit is conventionally set to be equivalent to a slope of a line connecting the starting feeding point to the center of the starting circular antenna unit. In the present invention, for example, the starting feeding point 235P is substantially the middle point of the lower edge of the antenna unit 235, as shown FIG. 2. Therefore, default feeding points 220P, 230P, 240P, 245P and 250P are designed to be substantially the middle points of the lower edges of the other antenna units 220, 230, 240, 245 and 250 for coupling to the signal transmission lines, respectively.

In the present invention, the signal transmission lines 210*b* and 210*d* are coupled to the default feeding points 230P and 240P of the antenna units 230 and 240. On the other hand, the signal transmission lines 210*a*, 210*c* and 210*e* are not coupled to the default feeding points 220P, 245P and 250P of the antenna units 220, 245 and 250. Instead, the signal transmission lines 210*a*, 210*c* and 210*e* are coupled to actual feeding points 220R, 245R and 250R of the antenna units 220, 245 and 250, which are differently located from the default feeding points 220P, 245P and 250P. The antenna units, e.g. the antenna units 220, 245 and 250, having different actual feeding points and default feeding points are referred to as off-site-fed antenna units.

Figure 3:
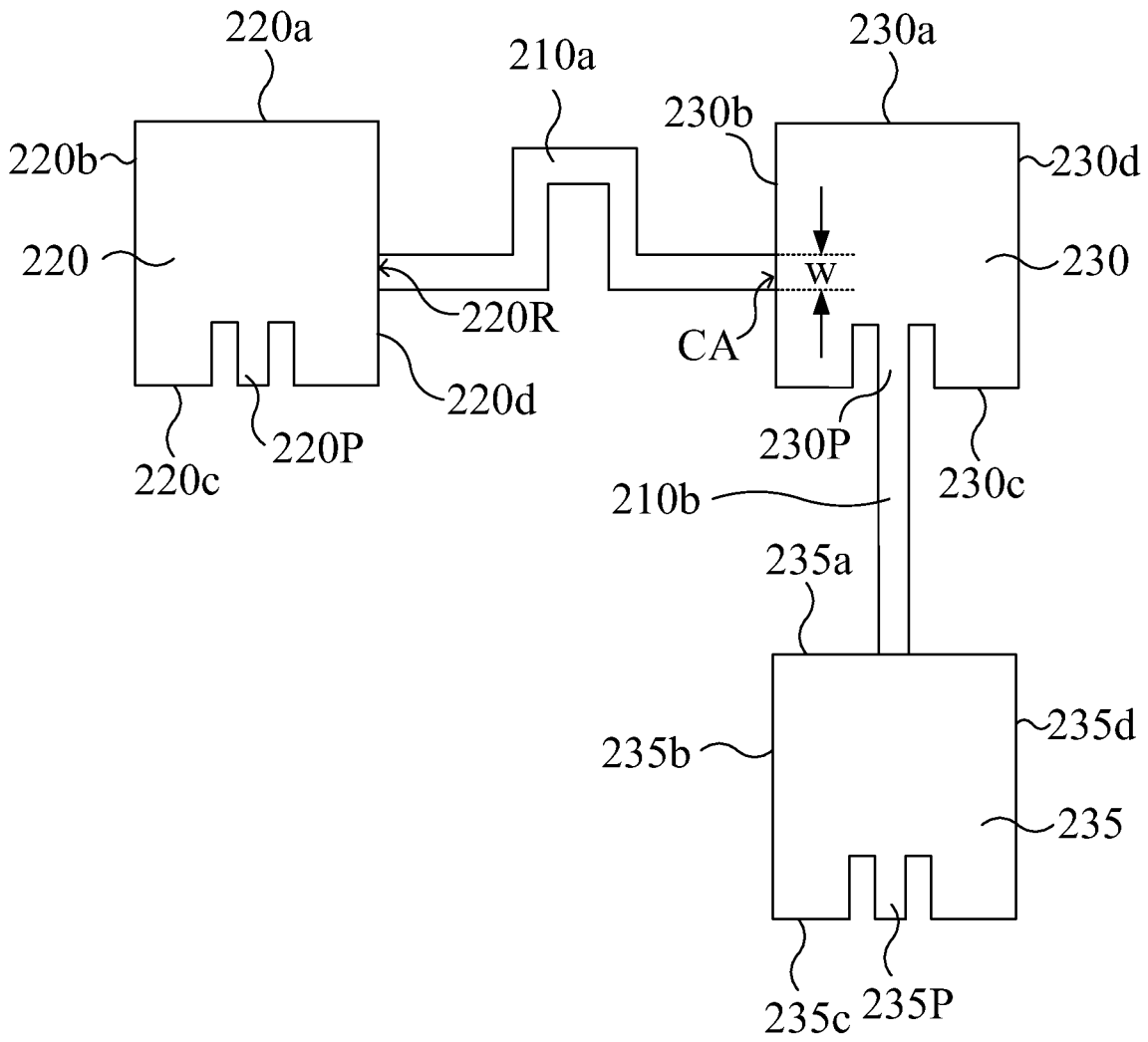
FIG. 3 is a schematic diagram illustrating interactions among antenna units 220, 230 and 235 included in the antenna array of FIG. 2.

The actual feeding points, e.g. 220R, 245R and 250R, may be designed according to practical requirements. Referring to FIG. 3, the antenna units 220, 230 and 235 in the antenna array are illustrated. The antenna unit 220 has four edges 220*a*, 220*b*, 220*c* and 220*d*. The default feeding point 220P is disposed at the edge 220*c*, and the actual feeding point 220R is disposed at the edge 220*d*. The antenna 230 has four edges 230*a*, 230*b*, 230*c* and 230*d*. The default feeding point 230P is disposed at the edge 230*c*. The antenna 235 has four edges 235*a*, 235*b*, 235*c* and 235*d*. The default feeding point 235P is disposed at the edge 235*c*. The default feeding point 235P, which is also the starting feeding point of the antenna array unit 200A, is coupled to the feeding point IN of the antenna array 20, and receives the external input signal therefrom. The external input signal is transmitted to the antenna unit 230 through the antenna unit 235, the edge 235*a* of the antenna unit 235, and then the signal transmission line 210*b*. The signal transmission line 210*b* is coupled to the default feeding point 230P at the edge 230*c* of the antenna unit 230, where the input signal enters the antenna unit 230. The input signal is transmitted to the antenna unit 220 through the antenna unit 230, the edge 230*b* of the antenna unit 230, and then the signal transmission line 210*a*. The signal transmission line 210*a* is coupled to the actual feeding point 220R at the edge 220*d* of the antenna unit 220, where the input signal enters the antenna unit 220.

The antenna unit 235 and the antenna unit 230 are coupled to each other via the signal transmission line 210*b*, which connects to the default feeding point 230P. On the other hand, the antenna unit 230 and the antenna unit 220 are coupled to each other via the signal transmission line 210*a*, which connects to the actual feeding point 220R at the edge 220*d* instead of the default feeding point 220P at the edge 220*c*.

In this embodiment, one end of the signal transmission line 210*a* is directly coupled to the edge 220*d* of the antenna unit 220, and the other end is directly coupled to the edge 230*b* of the antenna unit 230. Since the input signal enters the antenna unit 230 from the default feeding point 230P, the intensity of the input signal transmitted regularly from the antenna unit 230 to the antenna unit 220 through the signal transmission line 210*a* can be determined according to a distance of a characteristic position CA, where the signal transmission line 210*a* is coupled between the edge 220*d* of the antenna 220 and an adjacent edge 230*a* or 230*c* of the antenna unit 230, and the width w of the signal transmission line 210*a*. Furthermore, once the characteristic position CA is determined, the phase of the input signal transmitted to the antenna unit 220 can be determined according to the length of the signal transmission line 210*a*. It is to be noted that for setting the variables, e.g. the characteristic position CA, the actual feeding point 220R and the width/length of the signal transmission line 210*a*, for determining a certain intensity and a certain phase of the input signal can be arbitrarily rearranged. For example, the characteristic position CA is determined first, then the actual feeding point 220R is determined, and finally the width/length of the signal transmission line 210*a*. In this way, the phase of the input signal entering the antenna unit 220 can be determined in advance. In other words, even if the actual feeding point is changed to another position at the edge 220*d*, the input signal can still exhibit a desired phase at the alternative feeding point by adjusting the length of the signal transmission line 210*a*. For making a distinction, an antenna unit which has an actual feeding point different from the default feeding point of the same antenna unit, e.g. the antenna unit 220, is referred to as an off-site-fed antenna unit. In contrast, the antenna unit, e.g. the antenna 230, from which the input signal is transmitted to the off-site-fed antenna unit, e.g. the antenna unit 230, is referred to as an off-site-feeding antenna unit.

According to the present invention, the default feeding point is not the only feeding point of the antenna unit, so the design of the signal transmission line can be flexibly adjusted. It is to be noted that in spite each the signal transmission line illustrated in the above embodiment connects edges of two adjacent antenna units, which face each other, there is no need to limit the layout of the antenna units and the signal transmission lines in this way. For example, the signal transmission line 210*a* may connect the edges in the same orientation, e.g. 230*b* and 220*b*, or 230*a* and 220*a*, or the edges in opposite orientations, e.g. 230*b* and 220*d*, or 230*a* and 220*c*. Likewise, the other signal transmission lines may also be flexibly arranged for different circuitry designs.

Figure 4A:
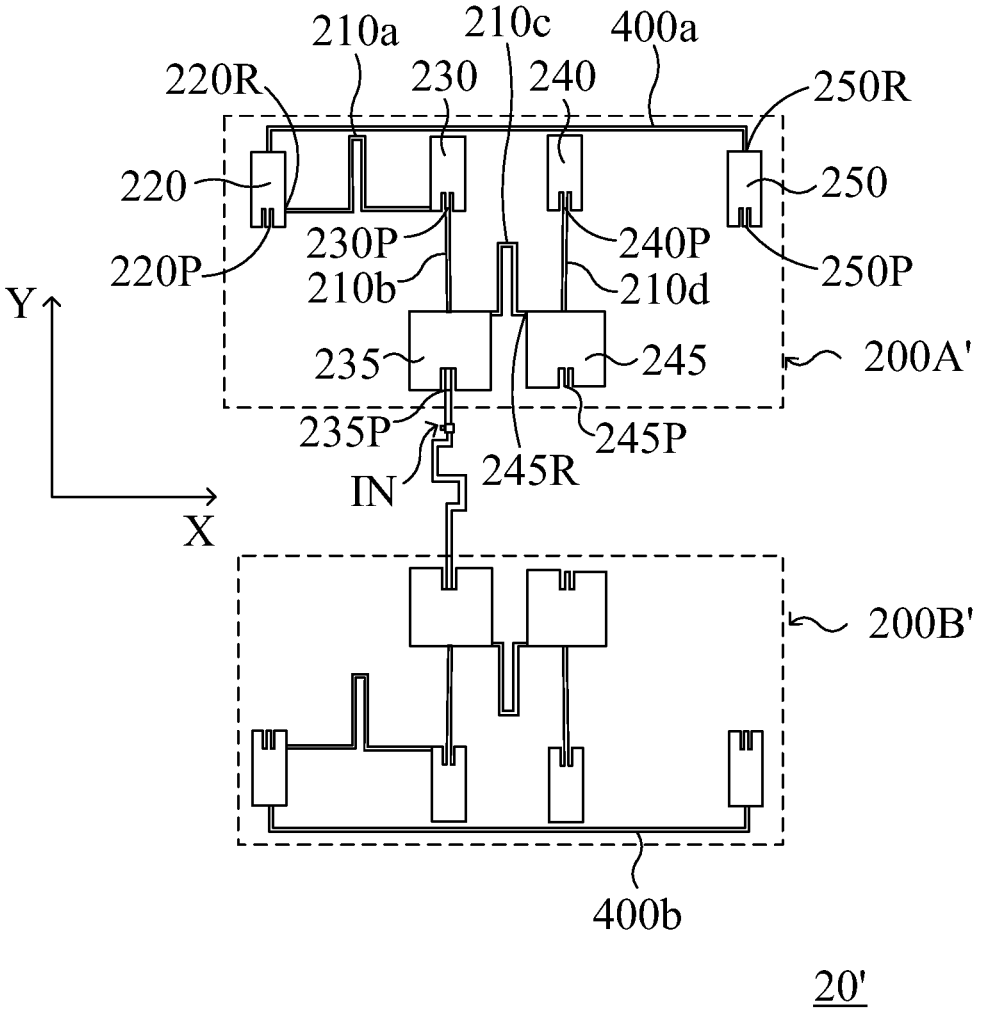
FIG. 4A is a schematic diagram illustrating an antenna array according to another embodiment of the present invention.
Figure 4B:
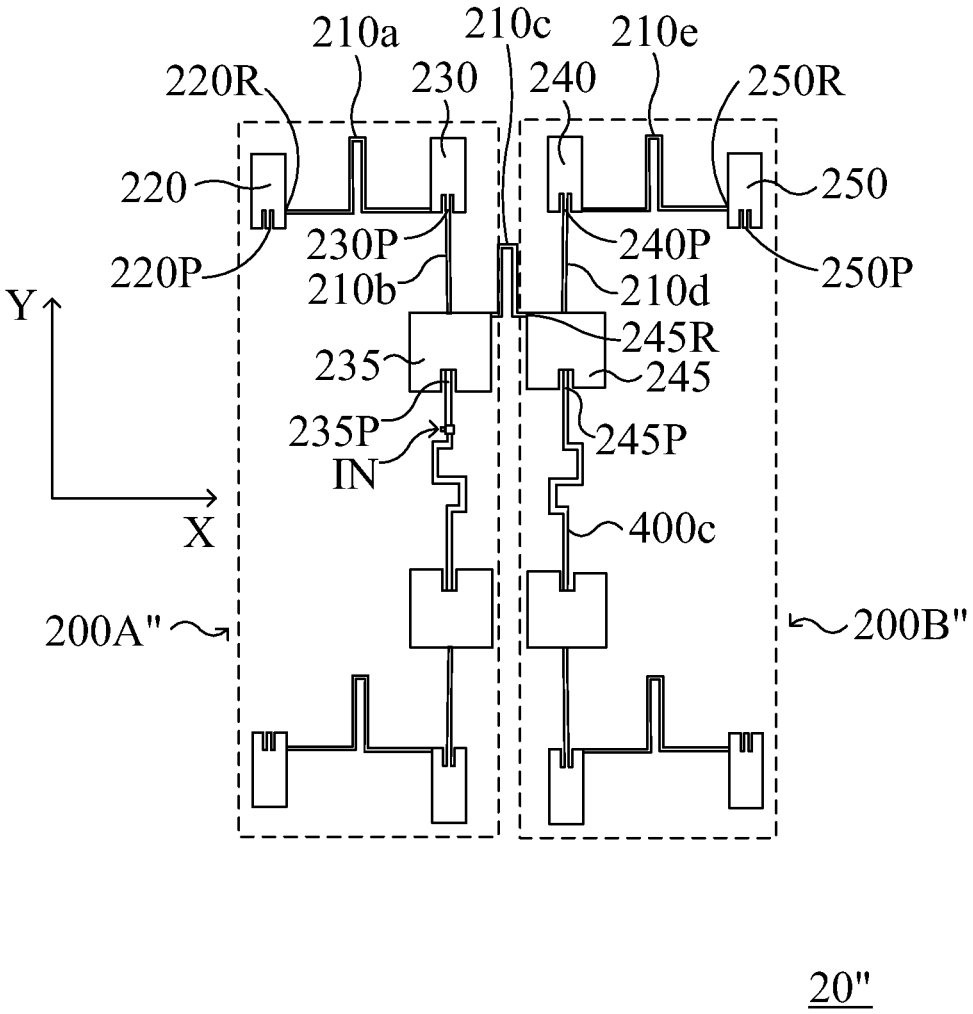
FIG. 4B is a schematic diagram illustrating an antenna array according to a further embodiment of the present invention.

Furthermore, the signal transmission line may connect any two of the antenna units instead of adjacent antenna units. The modifications and variations of the signal transmission lines as described above can still be applied to construct the final antenna array. Please refer to FIG. 4A, in which another embodiment of antenna array according to the present invention is illustrated. The antenna array 20' illustrated in FIG. 4A is similar to the antenna array 20 illustrated in FIG. 2, but the arrangement of signal transmission lines is changed in each of the antenna array units 200A' and 200B'. In this embodiment, there is no signal transmission line between the antenna units 240 and 250 of the antenna array unit 200A. Instead, an additional signal transmission line 400*a* is provided between the antenna units 220 and 250. In this embodiment, the actual feeding point 250R where the additional signal transmission line 400*a* is coupled to the antenna unit 250 is at the upper edge of the antenna unit 250. The input signal is transmitted from the antenna unit 220 to the antenna unit 250 through the signal transmission line 400*a*, thereby completing the resonance effect of the entire antenna array unit 200A' and generating an expected electromagnetic wave signal. Similar changes are made in the antenna array unit 200B', wherein an additional signal transmission line 400*b* is provided to complete the resonance effect of the entire antenna array unit 200B' and generating an expected electromagnetic wave signal. Alternatively, compared with FIG. 2, an embodiment of the antenna array according to the present invention, as illustrated in FIG. 4B, may be constructed without the signal transmission line 210*f* of the antenna array unit 200B as shown in FIG. 2, and meanwhile add a signal transmission line 400*c* between the antenna array unit 200A and the antenna array unit 200B as shown in FIG. 2 to form alternative antenna array units 200A" and 200B". Furthermore, the output points of the antenna units, e.g. CA, may be disposed at any proper positions. For example, the default feeding point 245P shown in FIG. 4B is used as an output point of the antenna unit 245 for transmitting the input signal between antenna units through the signal transmission line 400*c* in this embodiment. It is understood more possible modifications and variations may be made to construct an antenna array according to the present invention as desired.

In the above embodiments, some interconnected antenna units are longitudinally arranged, e.g. the antenna units 230 and 235, and others are transversely arranged, e.g. the antenna units 220 and 230. Nevertheless, the arrangements of the antenna units may be alternatively changed according to practical requirements. For example, some of the antenna units may be arranged as a curve line with a certain curvature.

It is understood from the above embodiments and descriptions that the signal transmission paths are not limited to a specific direction, e.g. among the antenna units in the same column. Alternatively, the signal transmission paths may be arranged among the antenna units in different rows and/or columns.

In summary, in the antenna array according to the present invention, the antenna units are allowed to have different feeding points so as to make the circuitry designs flexible. Furthermore, it is not necessary to have each of the antenna array units directly receive the input signal from the external signal feeding point IN, the total length of traces can be reduced to save occupied area and ameliorate the interference among signal lines.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna array, comprising:

an external input signal feeding point for receiving or transmitting therefrom an input signal or an output signal;

a plurality of signal transmission lines; and a plurality of antenna units including a starting antenna unit coupled to the external input signal feeding point via a starting feeding point thereof, and being interconnected via the plurality of signal transmission lines so that the input signal received from the external input signal feeding point enters the starting antenna unit from the starting feeding point and is further transmitted to the other antenna units through the plurality of signal transmission lines, wherein each of the antenna units is defined with a default feeding point at a position corresponding to a position of the starting feeding point in the starting antenna unit, and at least a specified one of the signal transmission lines has a first end directly coupled to a first one of the antenna units at an actual feeding point for delivering therefrom the input or output signal, wherein the actual feeding point of the first one of the antenna units is different from the default feeding point of the first one of the antenna units.

2. The antenna array according to claim 1, wherein the antenna units are arranged as a curve line with a certain curvature.

3. The antenna array according to claim 1, wherein the antenna units are linearly arranged.

4. The antenna array according to claim 1, wherein at least one of the plurality of signal transmission lines is directly coupled to two adjacent ones of the antenna units.

5. The antenna array according to claim 1, wherein at least one of the plurality of signal transmission lines is directly coupled to two of the antenna units, which are spatially separated by one or more of the other antenna units.

6. The antenna array according to claim 1, wherein the specified signal transmission line, which has the first end directly coupled to the first one of the antenna units at the actual feeding point, has a second end directly coupled to a second one of the antenna units at a characteristic position, wherein the second one of the antenna units is not adjacent to the first one of the antenna units, and a state of the input signal transmitted to the first one of the antenna units through the specified signal transmission line varies with the characteristic position of the second one of the antenna units.

7. The antenna array according to claim 6, wherein a state of the input signal transmitted to the first one of the antenna units through the specified signal transmission line further varies with a length and/or width of the specified signal transmission line.

8. The antenna array according to claim 7, wherein a state of the input signal transmitted to the first one of the antenna units through the specified signal transmission line further varies with the position of the actual feeding point of the first one of the antenna units.

9. The antenna array according to claim 1, wherein the specified signal transmission line has a second end directly coupled to a second one of the antenna units at a characteristic position, and a state of the input signal transmitted to the first one of the antenna units through the specified signal transmission line varies with the characteristic position of the second one of the antenna units.

10. The antenna array according to claim 1, wherein a state of the input signal transmitted to the first one of the antenna units through the specified signal transmission line varies with a length and/or width of the specified signal transmission line.

11. The antenna array according to claim 1, wherein a state of the input signal transmitted to the first one of the antenna units through the specified signal transmission line varies with the position of the actual feeding point of the first one of the antenna units.

* * * * *